United States Patent [19]

Riesen

[11] Patent Number: 4,546,799

[45] Date of Patent: Oct. 15, 1985

[54] DEVICE FOR CLEANING THE WEFT INSERTION AREA OF A WEAVING MACHINE

[75] Inventor: Peter Riesen, Elgg, Switzerland

[73] Assignee: Sulzer Brothers Limited, Winterthur, Switzerland

[21] Appl. No.: 655,146

[22] Filed: Sep. 27, 1984

[30] Foreign Application Priority Data

Oct. 11, 1983 [EP] European Pat. Off. ..... 83110110.0

[51] Int. Cl.[4] ..... D03D 49/00

[52] U.S. Cl. ..... 139/1 C

[58] Field of Search ..... 139/1 C; 15/345; 134/37; 68/5 R, 5 A

[56] References Cited

U.S. PATENT DOCUMENTS

| | | | |
|---|---|---|---|
| 2,400,792 | 5/1946 | Turner | 139/1 C |
| 3,491,801 | 1/1970 | Lippuner | 139/1 C |
| 4,230,158 | 10/1980 | Hintsch | 139/1 C |

FOREIGN PATENT DOCUMENTS

| | | | |
|---|---|---|---|
| 494463 | 3/1976 | U.S.S.R. | 139/1 C |

*Primary Examiner*—Henry S. Jaudon

*Attorney, Agent, or Firm*—Kenyon & Kenyon

[57] ABSTRACT

The weaving machine is provided with a slot nozzle for generating a vertical air curtain to remove fly, lint and the like from a travelling weft thread prior to entering into a shed. In addition, a cover plate is provided between the nozzle and the thread shear to limit the air curtain from the shed.

10 Claims, 5 Drawing Figures

DEVICE FOR CLEANING THE WEFT INSERTION AREA OF A WEAVING MACHINE

This invention relates to a device for cleaning the weft insertion area of a weaving machine.

As is known, in yarn processing, more or less detritus or fly is produced, depending on the type of yarn which is being processed. Further, this problem appears to an especially high degree at points where a yarn undergoes attritional stress, for example, a change of direction which occurs particularly in the yarn feeding and weft insertion area of a weaving machine. In fact, if an accumulation of fuzz, fly, lint or the like in this area is not prevented, these materials will pass into the shed together with the weft and will cause soiling of the fabric which is being produced. This can become especially serious if the fly had been fouled by lubricating oil in a picking mechanism before being taken along by the weft. As is known, fly which is introduced into a fabric reduces the quality of the fabric to an undesirable degree.

In the past, various types of devices have been known for cleaning or blowing out the work stations in a weaving machine in order to maintain the work stations free of fly and the like. In some cases, the devices have been constructed as blow-off and/or suction devices which are either installed in a fixed manner or which travel back and forth over the weaving machines of a plant room. In many cases, these devices employ air jets which sweep across the weaving machines, for example cross wise to the direction of the direction of travel of a weft. In these cases, the movement of the air jets has been produced by pivoting nozzles.

For example, German P.S. No. 1535894, German O.S. No. 1919229 and U.S. Pat. No. 2,798,825 describe devices which employ pivoting nozzles and which devices travel over the weaving machines of a plant room. However, such devices or installations are relatively expensive. Furthermore, because of the oscillation of the pivoting nozzles, it has not been possible to remove fly from a weaving machine in one direction only. This, however, is necessary, for example, in the weft insertion area of a weaving machine where the fly must be transported out of the picking mechanism counter to the weft direction.

German A.S. No. 2712983 describes a structure which employs fixed blowing devices. However, these fixed blowing devices blow off only a narrowly limited region of the machine and the fly blown out of this region is not completely removed from the machine. Other devices which are fixedly mounted are also known from Japanese Utility Model No. 4305/80 wherein a blowing nozzle is positioned above a picking mechanism while a suction nozzle is positioned below the picking mechanism. With this construction, the fly or lint seized by the air jets is picked up only in the "jet zone" of the blowing nozzle and is blown away to all sides. Hence, at least part of the fly is blown in the direction of the weft travel.

It has been found that the previously known devices for cleaning the weft insertion area often do not have the required efficiency.

Accordingly, it is an object of the invention to provide a simple and sturdy device for cleaning the weft insertion area of a weaving machine with which improved cleaning effects are obtained.

It is another object of the invention to be able to effectively clean the weft thread path in a weft inserting region of a weaving machine in an efficient manner.

Briefly the invention provides a nozzle for directing a vertical air curtain transversely of a thread path between a picking mechanism and a thread shear disposed along the thread path within a weaving machine as well as a cover plate between the nozzle and the shear in order to limit the air curtain from the shear. The combination of the nozzle and cover plate provide for an improved efficiency in the cleaning of the thread prior to passage to the thread shear.

The parts of the weaving machine which are moved in the direction to a slay during weft insertion support the tendency of fly material - both as the fly material is being formed and when the fly material is being whirled up by air jets which blow from the top down and impinge on and deflect from picking mechanism - to move with these parts in the direction of the travel of the weft thread. However the air curtain which is produced by the nozzle acts as a barrier to the passage of the fly material. Together with the cover plate, the air curtain shields the slay and, hence, the fabric from the fly created in the picking mechanism. The fiber particles (fluff), fly, and the like which move into the air curtain are then removed from the machine in a downward direction. Of note, depending on whether the yarn to be worked tends to from more or less fuzz, the cover plate may be opened or closed toward the bottom or may be prolonged.

In order to further clean the picking mechanism area in which much of the fly is produced by thread transfer, thread transport and thread braking, a second nozzle may be provided for directing a flow of air obliquely down into the picking mechanism in a direction opposite to the direction of travel of a thread in the thread path. In addition, a third nozzle extending crosswise to the thread direction may be provided to direct a curtain of air on to a thread brake and thread tensioner of the weaving machine transversely of the thread path. The use of the third nozzle also permits fly which is blown by the obliquely directed nozzle into its sphere of action to be removed from the machine. This third nozzle may be constructed to include a rotatable body for periodically intercepting the curtain of air discharged from the nozzle in order to create periodic deflections of the air curtain in opposition to the direction of travel of a thread in the thread path. For example, the rotatable body may be formed as a stepped body with at least one step. For example, the body may be formed of circular-cylindrical sectors with equal radii displaced relative to each other along a diameter so as to form two to four steps on the circumference of the stepped body. The rotatable body may also be driven either by a motor or by the air to be deflected. In either case, the number of deflections per minute, advantageously one to sixty and preferrably thirty deflections, can be limited by an adjustable friction brake.

The air jet which is periodically deflected by means of the rotatable body is able to sweep fly material in the manner of a broom in the direction of a bobbin rack before which the fly material may fall under the weaving machine in a simple manner.

The cover plate may also be provided laterally with a diaphram type closure which extends toward the thread entry side. Through such a closure, the jets forming the air curtain can be guided over a longer distance to bring about an improved blowing off of a projectile lubrication means.

By dividing the cleaning system into a number of individual elements which blow in different directions, insurance is provided that no "dead" corners will form in the picking mechanism in which fly could settle after having been seized and transported by the blast air.

In order to have a thread as fly-free as possible enter the thread-transfer areas of the picking mechanism, at least one cleaning nozzle is directed essentially parallel but counter to the weft travel on thread entry side of a fetch-back opener. If it should be found that with certain yarns, a major amount of fly forms or is also present on the slay side of the cover plate, a two-jet nozzle may be provided to direct inclined air jets above and below the weft thread on to a centering vane. Additional improvements in the cleaning of the area of a picking mechanism in a narrower sense, that is, in the case of a projectile machine, in the area of a projectile lifter, fetchback opener and beater, and guide rail, can be obtained if an additional oblique nozzle is provided between the air injection nozzle and an air discharge nozzle which blows essentially codirectionally with the air injection nozzle. In order to perfect the entire system, at least one suction nozzle may be provided under the picking mechanism, for example as described in Japanese Utility Model No. 4305/80.

The various nozzles may be operated to deliver intermittently produced air jets in order to further support the cleaning action by the shock effect of the resultant air jets. For example, pulse frequencies of from one to fifty per minute, and preferrably less than thirty per minute, can be used.

In order to simplify the installation required for the entire system, a common air feed for the slot nozzle, air injection nozzle and oblique nozzle may be provided. Further, the speeds or energies of the "cleaning" air jets should be selected so that the fly material is extensively removed but that the conduction and position of the thread is not impaired.

The extent to which the basic system can be supplemented depends on the yarn material which is being woven and the desired fabric quality in comparison with the cost of installing additional measures.

These and other objects and advantages of the invention will become more apparent from the following detailed description taken in conjunction with the accompanying drawings wherein:

FIG. 1 schematically illustrates a weft insertion side of a weaving machine employing a nozzle and cover plate in accordance with the invention;

Figures 1, 2, 3:
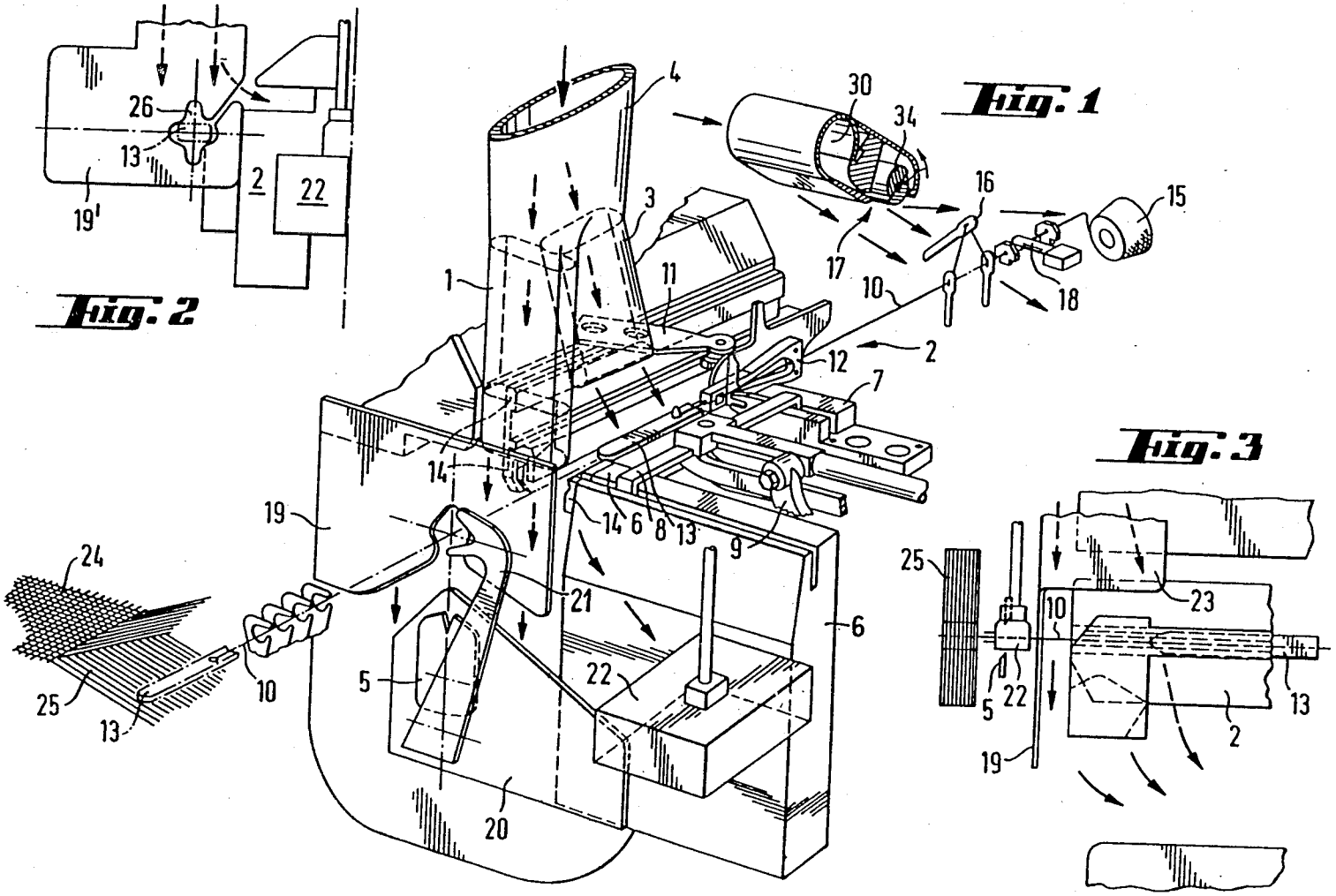
FIG. 2 illustrates a modified cover plate in accordance with the invention.
FIG. 3 illustrates a partial side view of the structure illustrated in FIG. 2.

Referring to FIG. 1, a weft insertion side of a weaving machine is constructed in known fashion to pick a weft thread 10 by means of a projectile 13 into a shed 25 of warp yarns in order to form a fabric 24. To this end, the weaving machine includes a weft thread bobbin 15, a thread brake 18, a thread tensioner 16, a picking mechanism 2, a thread shear 5, a centering vane 21 and a projectile lubication means 22. The picking mechanism which is shown schematically and in part includes front and rear lock blocks 6,7, a fetch-back opener 8 with an associated drive lever 9, a fetch-back lever 11, a fetch-back or thread feeder 12 and guides 14 for a beating means 50 (see FIG. 5).

In accordance with the invention, an air cleaning system for the weaving machine includes a slot nozzle 1 for directing a vertical air curtain between a picking mechanism 2 and the shear 5 transversely of the thread path. As shown, the slot nozzle 1 is set transverse to the weft direction. In addition, an air injection nozzle 3 is provided for directing a flow of air obliquely down on to the picking mechanism 2 in a direction opposite to the direction of travel of the thread 10 in the thread path. As indicated, the nozzles 1,3 are mounted at the end of a common distributing line 4 so as to receive a supply of air therefrom.

The air stream issuing from the inclined air injection nozzle 3 is directed above and on to all of the guides 14 and on to the thread transfer.

Referring to FIG. 1, an air discharge device 17 is also disposed downstream of the thread tensioner 16 for directing a curtain of air on to the tensioner 16 and brake 18 transversely of the thread path. To this end, the air discharge device 17 is constructed as a nozzle which is able to periodically deflect an air jet so as to sweep over the tensioner 16, brake 18 and bobbin.

Referring to FIG. 1, a cover plate 19 is provided between the slot nozzle 1 and the shear 5 in order to limit the air curtain from the nozzle 1 from the shear 5 and, hence, from the fabric 24. As indicated, the cover plate 19 is open toward the bottom and is disposed above a cam plate 20 mounted on the front lock block 6 for the control of the thread shear 5. As indicated by arrows in the foreground, a part of the air flowing out of the slot nozzle 1 passes vertically downward while another part is blown onto the projectile lubrication means 22 which lies before the front lock block 6 and before the cam plate 10 in FIG. 1. A blow cleaning of the projectile lubrication means 22 can be improved if the cover plate 19 is supplemented, as shown in FIG. 3, by means of a lateral vane 23 extending parallel but opposite to the direction of travel of the weft thread 10.

Referring to FIG. 2, a cover plate 19' which is closed toward the bottom can be employed when working with yarns which have little tendency to fly formation or where only relatively short fiber fluff detaches from the yarn. In this case, the cover plate 19' forms a practically continuous wall with a passage opening 26 only for the projectile 13. Further, the use of a downwardly closed or prolonged cover plate 19' improves the shielding between the air curtain and the shed.

Figure 4:
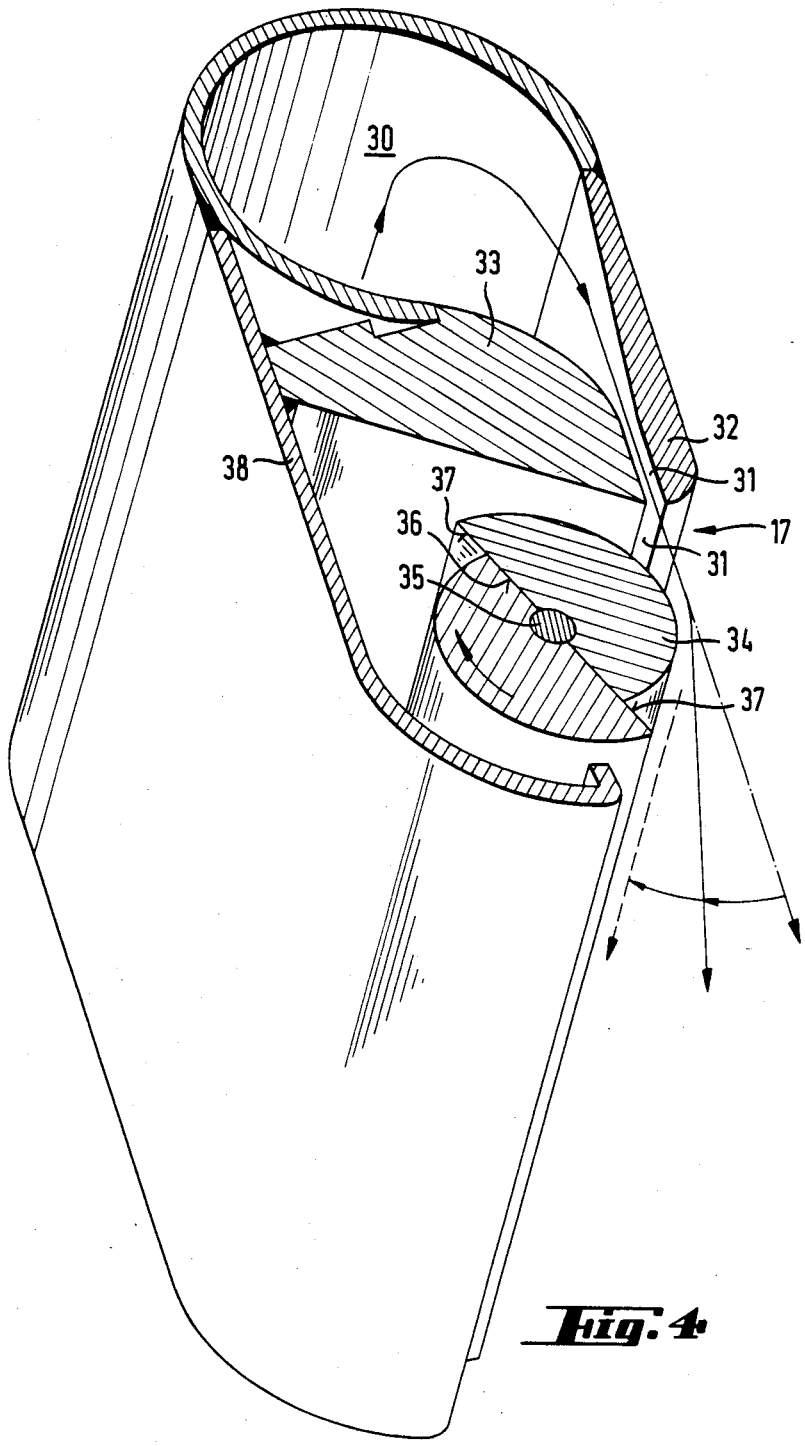
FIG. 4 illustrates an air discharge device employed in the overall cleaning system in accordance with the invention.

Referring to FIG. 4, the air discharge device 17 is provided with a housing which defines a chamber 30 for receiving a flow of compressed air from a compressed air line (not shown). In this regard, the housing is closed at the free end by a back wall (not shown). In addition, the housing has a tangential air discharge slot 31 communicating with the chamber 30 and narrowing therefrom in funnel form in order to discharge a stream of air as indicated. As shown, the slot 31 is defined by a side wall 32 of the housing and by a shaped body 33 disposed within the housing.

In addition, the air discharge device includes a rotatable body 34 for periodically intercepting the stream of air discharged from the slot 31 in order to create periodic unilateral deflections of the stream of air as indicated by the arrows. This rotatable body is mounted to rotate via an axle 35 on a longitudinal axis while being driven, for example by an electric motor (not shown). As indicated, the rotatable body 34 is formed of pair of circular-cylindrical sectors which are disposed in offset relation along a common diametric plane 36 to define a pair of circumferentially spaced steps 37. In addition, the rotatable body 34 is disposed adjacent to the exit end of the slot 31 with the axle 35 offset laterally to the exit end of the slot so that the curved surfaces of the body 34 protrude into the air stream issuing from the slot 31 to deflect the stream unilaterally in the direction of the body 34.

The steps 37 of the body 34 which are created by the cylinder halves cause the flow of air along the curved surface to break off after one half revolution of the body 34 so that the deflection of the air jet ceases and the air flow "jumps back" into the discharge slot 34. With the body 34 unilaterally embraced partially by a wall 38 of the housing opposite the wall 32, periodic unilateral deflections of the air stream can occur if the body 34 rotates in a uniform and continuous manner. The periodic deflections in turn create an air jet which "sweeps" in the manner of an "air broom".

Figure 5:
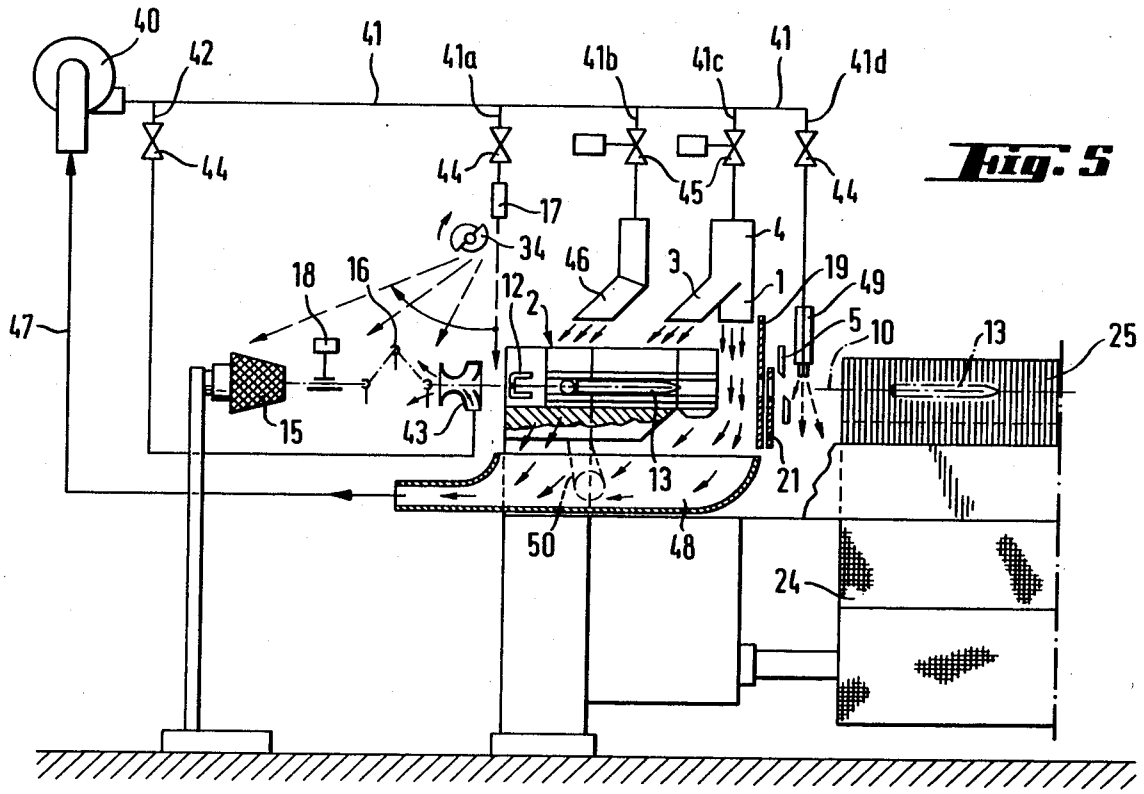
FIG. 5 illustrates a schematic view of a cleaning system for the weft insertion side of a weaving machine in accordance with the invention.

Referring to FIG. 5 wherein like reference characters indicate like parts as above, the air cleaning system may be supplemented with additional blow sites in order to keep the weaving machine clean and, hence, in the last analysis, in order to obtain an improved quality of the fabric produced, although at a higher cost of investment.

As shown in FIG. 5, all the blow sites in the weaving machine are supplied from a common fan 40 and supply lines 41,42 with air at an elevated pressure. The supply line 41 which supplies the blow sites above the weaving machine branches into a number of branch lines 41*a*–41*d* with one of the branch lines 41*c* leading into the compressed air line 4 to supply the nozzles 1,3.

Adjustable throttle elements 44, for example in the form of diaphrams, are provided in the branch lines 41*a*, 41*d* and the supply line 42 so that the air pressure and, hence, the blast air quantity in each line can be adjusted relative to the others. Motor driven valves 45 are provided in the branch lines 41*b*, 41*c* so that the nozzles connected thereto can be supplied with air flows which are blown out intermittently. The shock effect provided by these individual air jet pulses enhances the blowing and cleaning action. For example, the pulse frequencies are less than sixty per minute and preferrably under thirty per minute.

On the suction side, the fan 40 may either draw in air from the weaving room via a filter (not shown) or may be connected via an exhaust line 47 with a suction nozzle 48 extending under the picking mechanism 2 over a large area of the weft insertion so that the entire device is a largely closed air circulation system.

Without setting priorities for the desirability of the individual additional blow sites, the branch line 41*d* ends in a two-jet nozzle 49 on a side of the cover plate 19 common to the centering vane 21 and shear 5 so as to direct a flow of air transversely on to the centering vane 21. The two jets, however, do not impinge on the weft thread 10 itself but pass by the weft thread, for examole essentially in a forked manner so as not to disturb centering of the weft thread 10.

The branch line 41*b* extends to an oblique nozzle 46 which directs a stream of air obliquely on to the thread path between the air discharge nozzle 3 and the air discharge device 17. As indicated, the stream of air is directed codirectionally with the oblique flow of air from the nozzle 3. This oblique nozzle 46 blows on to the beating mechanism 50 and the thread transfer which is indicated by the fetch-back 12.

A cleaning nozzle 43 is also directed substantially parallel to the thread path and opposite to the direction of thread travel downstream of the tensioner 16 for directing a flow of cleaning air over the weft thread 10. As indicated, the cleaning nozzle 43 is in the form of a ring nozzle which is known, for example from Swiss Pat. No. 624,438 so that the thread running out of the thread tensioner 16 is freed as much as possible from fibers which may adhere to the thread 10 before arriving at the thread transfer. This nozzle 43 constitutes a very effective supplementation of the "air broom" formed by the air discharge 17. As also indicated, the nozzle 43 is connected to the supply line 42.

As can be determined from FIG. 5, the formation of "dead" corners within the weft insertion region of the weaving machine is prevented more extensively than that as indicated in FIG. 1 Moreover, additional low sites naturally result in an increased blowing and cleaning action and thus contribute to further improvement of the fabric qualities. To this end, the system of FIG. 5 provides a multiplicity of blow sites which serve to shield the fabric 24 against fiber fly as completely as possible while transporting the fly away from the machine counter to the direction of weft travel.

The invention thus provides a weaving machine with an air cleaning nozzle which is able to effectively and reliably prevent the passage of fly into the shed of a weaving machine. In this regard, the invention provides a slot nozzle from which a vertical air curtain can be disposed at a convenient point to prevent fly, lint and the like from passing directly into the shed with a travelling weft thread.

The invention further provides an air cleaning system which provides a multiplicity of blowing sites by means of which a weft thread can be cleaned of fly, dirt and the like which may form during thread transfer.

What is claimed is:

1. In combination a weaving machine having a picking mechanism and a thread shear disposed along a thread path;

a nozzle for directing a vertical air curtain between said picking mechanism and said shear transversely of said thread path; and a cover plate between said nozzle and said shear to limit said air curtain from said shear.

2. The combination as set forth in claim 1 which further comprises a second nozzle for directing a flow of air obliquely down into said picking mechanism in a direction opposite to the direction of travel of a thread in said thread path.

3. The combination as set forth in claim 2 wherein said weaving machine includes a thread brake and a thread tensioner in said thread path and which further includes a third nozzle for directing a curtain of air onto said brake and said tensioner transversely of said thread path.

4. The combination as set forth in claim 3 wherein said third nozzle is disposed downstream of said thread tensioner relative to said thread path.

5. The combination as set forth in claim 3 which further includes a fourth nozzle for directing a stream of air obliquely onto said thread path between said second and said third nozzles and co-directional with said second nozzle.

6. The combination as set forth in claim 5 which further comprises means for directing air through at least one of said nozzles intermittently.

7. The combination as set forth in claim 5 which further includes a common air feed connected to said nozzles.

8. The combination as set forth in claim 1 wherein said weaving machine includes a thread tensioner in said thread path and which further includes at least one nozzle directed substantially parallel to said thread path and opposite to the direction of thread travel in said path downstream of said tensioner for directing a flow of cleaning air over the thread.

9. The combination as set forth in claim 1 wherein said weaving machine includes a centering vane on a side of said cover plate common to said shear and which further comprises a two-jet nozzle on said common side of said cover plate for directing a flow of air transversely of said thread path onto said vane.

10. The combination as set forth in claim 1 which further comprises a suction nozzle under said picking mechanism for drawing off a flow of air.

* * * * *

UNITED STATES PATENT AND TRADEMARK OFFICE

CERTIFICATE OF CORRECTION

PATENT NO. : 4,546,799

DATED : October 15, 1985

INVENTOR(S) : Danilo Vezzu, et al

It is certified that error appears in the above-identified patent and that said Letters Patent is hereby corrected as shown below:

Front Page: Item [19] "Riesen" should read --Vezzu, et al--.

Inventors: Danilo Vezzu, Seuzach;
Walter Moser, Winterthur;
Peter Riesen, Elgg,
all of Switzerland Column 2, line 4 change "Briefly the" to -Briefly, the-
Column 2, line 18 change "from picking" to -from the picking-
Column 4, line 28 change "bobbin." to -bobbin 15.-
Column 4, line 40 change "cam plate 10" to -cam plate 20-
Column 5, line 4 change "of pair" to -of a pair-
Column 5, line 63 change "examole" to -example-
Column 6, line 22 change "Fig. 1" to -Fig. 1.-
Column 6, line 22 change "low" to -blow- Signed and Sealed this First Day of April 1986

[SEAL]

*Attest:*

*Attesting Officer*

DONALD J. QUIGG

*Commissioner of Patents and Trademarks*